United States Patent [19]

Kohm et al.

[11] 4,236,333

[45] Dec. 2, 1980

[54] SIGN STRUCTURE

[76] Inventors: Richard C. Kohm, 3847 French Ct., St. Louis, Mo. 63116; C. Thomas Foster, 77 Crandon, No. 9D, Key Biscayne, Fla. 33149

[21] Appl. No.: 966,928

[22] Filed: Dec. 6, 1978

[51] Int. Cl.[3] ..... G09F 21/06

[52] U.S. Cl. ..... 40/212; 40/215; 40/452; 339/144 R

[58] Field of Search ..... 40/212, 215, 550, 583, 40/452, 214; 339/144 R, 144 T, 145 R; 362/62

[56] References Cited

U.S. PATENT DOCUMENTS

| | | | |
|---|---|---|---|
| 1,429,602 | 9/1922 | Lyle | 339/145 R |
| 1,701,205 | 2/1929 | Glatzner | 40/452 |
| 1,982,960 | 12/1934 | Links | 40/212 |
| 2,115,575 | 4/1938 | Geiger | 339/145 R X |
| 3,569,690 | 3/1971 | Nelson | 362/62 |
| 3,683,530 | 8/1972 | Robinson | 40/215 |
| 3,708,900 | 1/1973 | Robinson | 40/212 |
| 3,849,921 | 11/1974 | Nelson | 40/212 |

FOREIGN PATENT DOCUMENTS

| | | | |
|---|---|---|---|
| 564273 | 12/1923 | France | 40/212 |
| 1138979 | 6/1957 | France | 40/212 |
| 65444 | 8/1933 | Switzerland | 40/212 |

*Primary Examiner*—John F. Pitrelli
*Assistant Examiner*—Skillington G. Lee
*Attorney, Agent, or Firm*—Richard J. Sher

[57] ABSTRACT

A sign structure which may be supported from aircraft, and especially helicopters. The structure is comprised of three distinct sections which may be compactly transported and then easily assembled and connected around the landing gear on the underside of the aircraft. The structure provides an aerodynamically stable frame which may be supported in a direction transverse to the longitudinal axis of a helicopter. Novel electrically controlled light assemblies are attached in a rectangular matrix on the structure for displaying a desired illuminated message.

14 Claims, 10 Drawing Figures

SIGN STRUCTURE

BACKGROUND AND SUMMARY OF THE INVENTION

The present invention relates to sign structures and especially to illuminated display sign structures which may be mounted upon stationary edifices or boats and the like, and which may be attached to and supported beneath aircraft and especially helicopters for the purpose of conveying a written message, especially an advertising message.

Fixed wing aircraft have been carrying advertising signs for many years and sign structures used in conjunction with fixed wing aircraft are exemplified by U.S. Pat. Nos. 3,849,921; 1,982,960; 1,701,204; and 1,474,682.

It is also well known that in more recent years sign structures have been designed which can be supported from helicopters. These sign structures are represented by U.S. Pat. Nos. 3,683,530 and 3,708,900 as well as French Pat. No. 1,138,979. It is noted at the outset that none of the helicopter sign structures known to applicant are adapted to be supported beneath the helicopter with the longitudinal axis of the sign structure being perpendicular to the longitudinal axis of the helicopter frame.

The sign structure herein described differs markedly from those of the prior art in a number of important aspects. It is an exceptionally large structure capable of being supported by a helicopter in flight and when flown over large gatherings of people, it provides a uniquely large advertising message which may be clearly viewed from the ground. The large message being displayed is situated horizontally thus allowing the craft to hover at the closest possible safe proximity to the gathering, rendering the message more readable and thus more effective.

It would be expected that a very large advertising sign structure would be unwieldy both from the standpoint of shipment to the location of the edifice or aircraft on which it is to be mounted and from the standpoint of connection and disconnection to the edifice or aircraft. Yet the present invention is uniquely designed to embody three distinct sections; a first end section, an intermediate section and a second end section, which may be shipped separately or in a compact easily handled bundle. Upon arrival, the three sections may be connected together in a facile manner to form the sign structure. Only unskilled labor and simple hand tools are required for the assembly which can be accomplished in a matter of minutes. Further, the structure of the present invention is designed for ease of installation of the intermediate section around the landing gear of an airplane or helicopter. The entire sign structure may be mounted beneath the aircraft quickly and in such a way that it does not obstruct or interfere with the safe take off, flight, or landing of the aircraft. The structure provides a very large message yet does not require any moving parts for changing its position during the flight of a helicopter as is the case in U.S. Pat. Nos. 3,683,530 and 3,708,900, and the structure may be quickly and easily disconnected from the aircraft when desired. If one of the sign sections should be damaged, the section may be economically replaced instead of having to replace the entire sign.

The sign structure also includes novel electrically energized light source assemblies which prevent light bulbs from becoming loose and inoperative or even falling from the sign due to the high wind forces experienced during the flight of the aircraft; yet the assemblies make it possible to very quickly and easily change a burned-out bulb.

It is therefore an object of the invention to provide a structure having at least three distinct sections which can be easily transported to a desired site and then quickly and easily connected together to form a large message displaying sign.

It is another object of the invention to provide a large sign structure which can be quickly connected beneath and disconnected from an aircraft in such a manner as to cause no interference to the safe operation of the aircraft.

It is a further object of the invention to provide a large sign structure for use with a helicopter which may be situated horizontally with the longitudinal axis of the sign structure perpendicular to the longitudinal axis of the helicopter frame.

It is a still further object of the invention to provide a novel, electrically-energized light source assembly for use on the sign structure which prevents light bulbs from becoming loose and inoperative during use and yet furnishes a facile means of replacing a burned-out bulb.

These as well as other objects and advantages of the present invention will become more apparent from a reading of the following detailed description of a preferred embodiment of the invention in conjunction with the drawings wherein.

DETAILED DESCRIPTION OF THE PREFERRED EMBODIMENT

Figure 1:
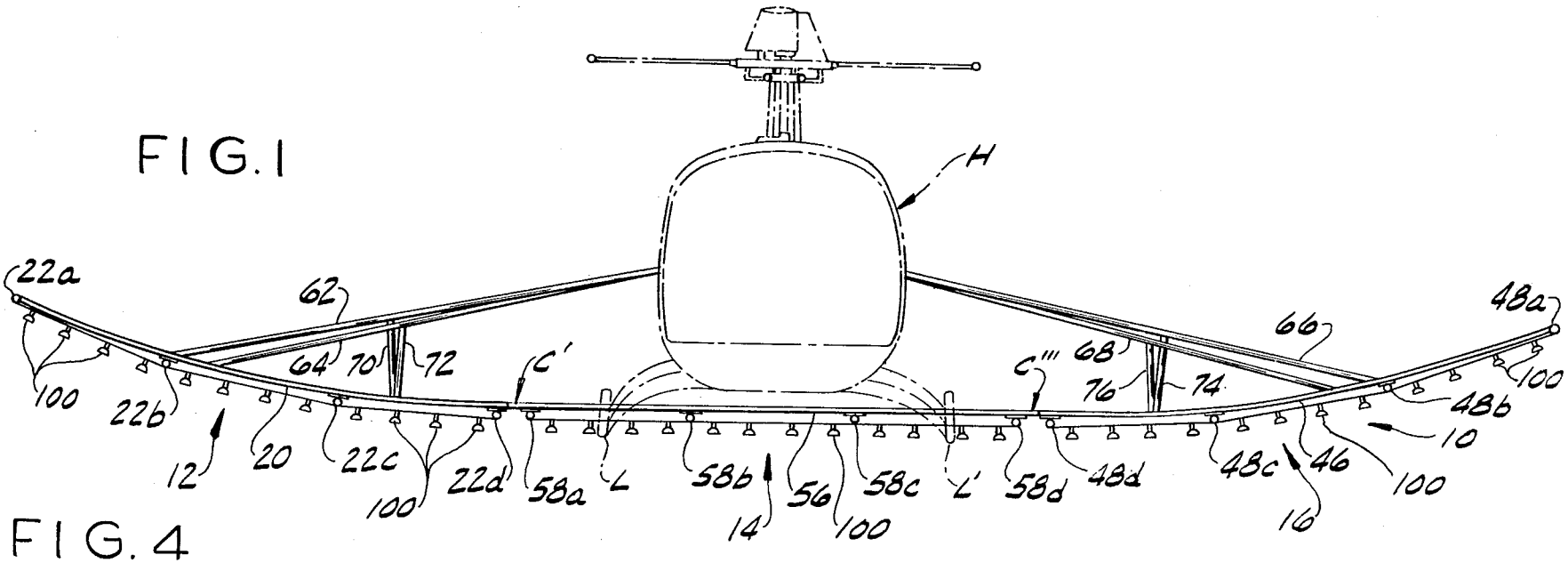
FIG. 1 is a front view of the sign structure shown as it would be mounted on a helicopter which is shown in phantom.
Figure 2:
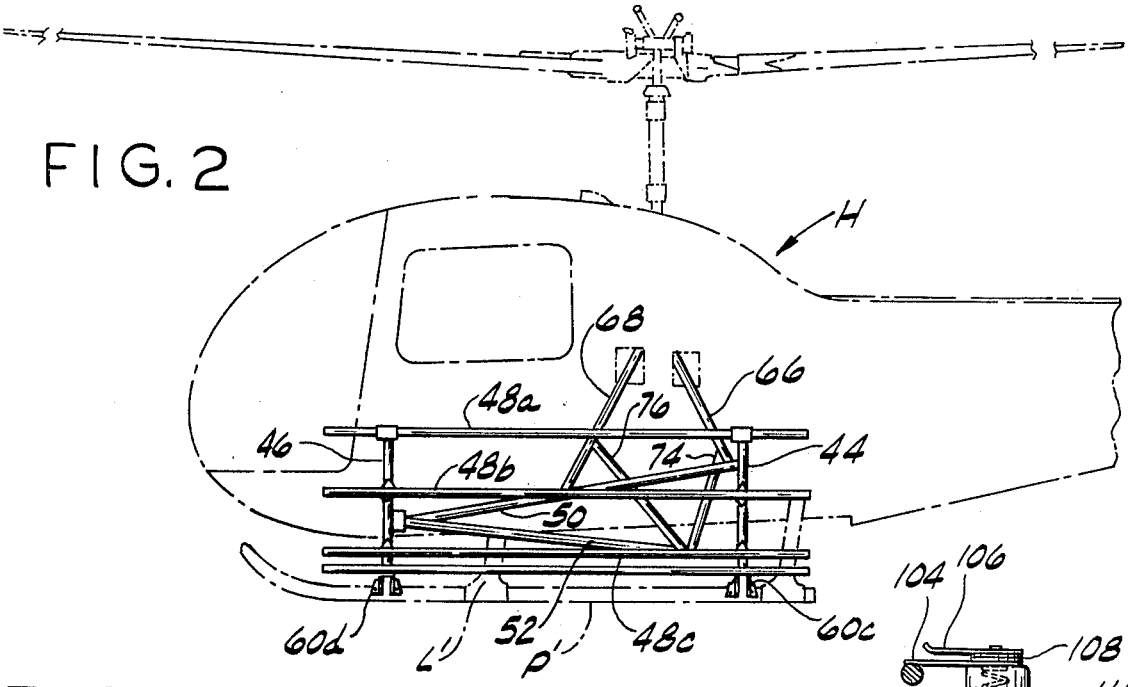
FIG. 2 is a side view of the sign structure shown in FIG. 1 with the wire grid deleted for clarity.
Figures 3, 5, 6:
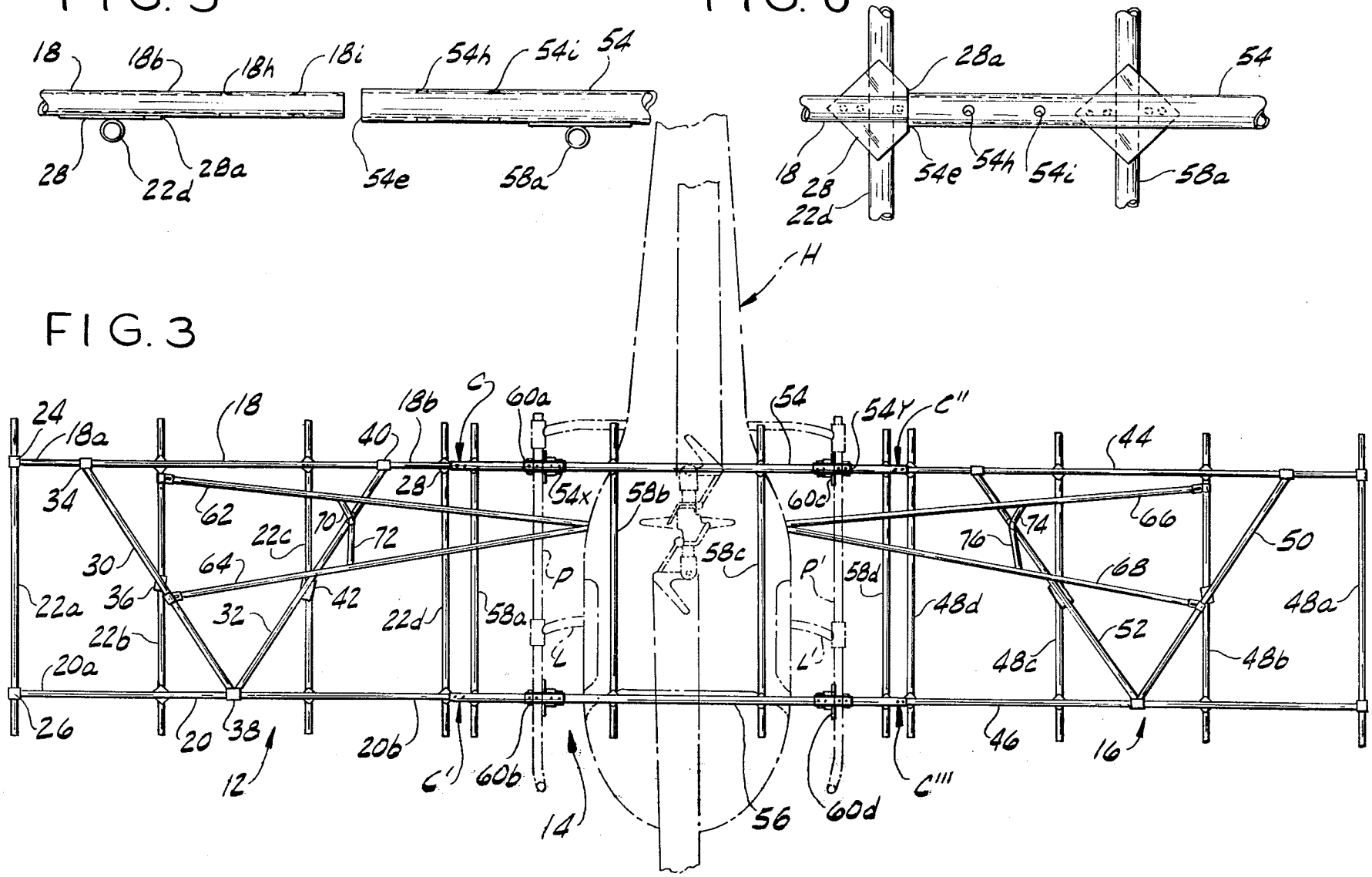
FIG. 3 is a top view of the sign structure shown in FIG. 1 with the wire grid deleted for clarity.
FIG. 5 is an enlarged front exploded view of a typical connection point between two sections of the structure.
FIG. 6 is an enlarged top view of a typical connection point after assembly.

With reference to the drawings wherein like numerals indicate like elements, there is shown in FIGS. 1–3 a sign structure 10 as it may be utilized with a helicopter H shown in phantom line. It is noted that in FIGS. 2 and 3 the wire grids and light bulb assemblies mentioned hereinabove have been deleted for the sake of clarity. It is further noted that sign structure 10, while specifically shown as it would be utilized with a helicopter, may be utilized on any edifice, boat, airplane or the like with advantageous results.

Sign structure 10 is comprised of three main sections (see FIG. 4), referred to herein as a first end section 12, an intermediate section 14 and a second end section 16. Sections 12, 14 and 16 each consist of a generally rectangular framework of members fabricated from tubular metal stock material, and as will be explained in detail hereinafter, sections 12, 14 and 16 are designed to be fitted together to form the basic framework of sign structure 10.

End section 12 is fabricated of first support member 18, a second support member 20 situated parallel to and spaced from support member 18, and four stabilizer members 22*a*, 22*b*, 22*c* and 22*d* each spaced from the other and situated perpendicularly to support members 18 and 20. As shown, the ends of stabilizer members 22*a*, 22*b*, 22*c* and 22*d* extend slightly beyond the intersections between the support members and the stabilizer members, and while the ends 18*a* and 20*a* of support members 18 and 20, respectively, terminated at the intersections thereof with stabilizer member 22*a*, the opposite ends 18*b* and 20*b* of support members 18 and 20, respectively, extend slightly beyond the intersections thereof with stabilizer member 22*d*. The ends 18*a* and 20*a* of support members 18 and 20 are held in place with respect to stabilizer member 22*a* by respective metal plate members 24 and 26 which are placed over both member 22*a* and ends 18*a* and 20*a*, respectively. Plate member 24 is then spot welded, riveted or the like onto both member 22*a* and end 18*a* of member 18. Plate member 26 is likewise attached to member 22*a* and end 20*a* of member 20 thus providing a secure connection between members 18, 20 and 22*a*. Also, at every location where either support member 18 or 20 intersects and crosses over one of the stabilizer members 22*b*, 22*c* or 22*d*, a similar metal plate member, for example at 28, is placed between the intersecting members and both of the intersecting members, for example 22*d* and 18, are spot welded or the like to the same plate member such as plate 28. For a more detailed view of a typical connection between crossing members see FIG. 6.

End section 12 also includes reinforcing members 30 and 32. Reinforcing member 30 is connected to support member 18 by means of connecting plate 34, extends across stabilizer member 22*b*, and is connected thereto by means of connecting plate 36, and member 30 terminates at plate 38 where it is connected to support member 20. Reinforcing member 32 is connected to support member 18 by means of plate 40, passes over stabilizer member 22*c* where it is connected thereto by plate 42 and terminates at plate 38 which attaches it to support member 20.

End section 16 is constructed in an identical manner as end section 12 except that it is the mirror image thereof. End section 16 includes support members 44 and 46, stabilizer members 48*a*, 48*b*, 48*c* and 48*d* and reinforcing members 50 and 52.

Intermediate section 14 includes support members 54 and 56 and stabilizer members 58*a*, 58*b*, 58*c* and 58*d*. The major difference in the construction between intermediate section 14 and the end sections 12, 16 is that intermediate section 14 does not include reinforcing members and both ends on both support members 54, 56 extend beyond the end stabilizer members 58*a* and 58*d*. Further, the inside diameter of tubular members 54 and 56 is such that support members 18, 20 and 44, 46 may be telescopically engageable within tubular members 54 and 56 as will be discussed in greater detail hereinafter. Another difference which will be described in greater detail hereinafter is the fact that support member 54 is reconnectably severed at locations 54*x* and 54*y* to allow for the movement of member 54 around the helicopter landing gear L and L′ during connection and disconnection of sign structure 10 to or from helicopter H.

In use, intermediate section 14 is attached to the helicopter landing gear L, L′ by brackets 60*a*, 60*b*, 60*c*, 60*d* which are attached to the landing gear and extend upwardly to hold and support one of support members 54 and 56 above a respective landing pad P or P′.

End section 12 is maintained on one side of the helicopter frame by means of mounting members 62 and 64 and end section 16 is maintained on the opposite side of the helicopter frame by means of mounting members 66 and 68. Mounting members 62, 64, 66, 68 are attached to any of the support, stabilizer or reinforcing members of a respective end section by means of a circular clamp captively engaging the member and having a metal tab thereon for attachment to an end of the mounting member. The mounting members are connected to the helicopter frame in any well known manner. Further, reinforcement members 70, 72, 74 and 76 are included to further reinforce and stabilize the entire assembly.

Figure 4:
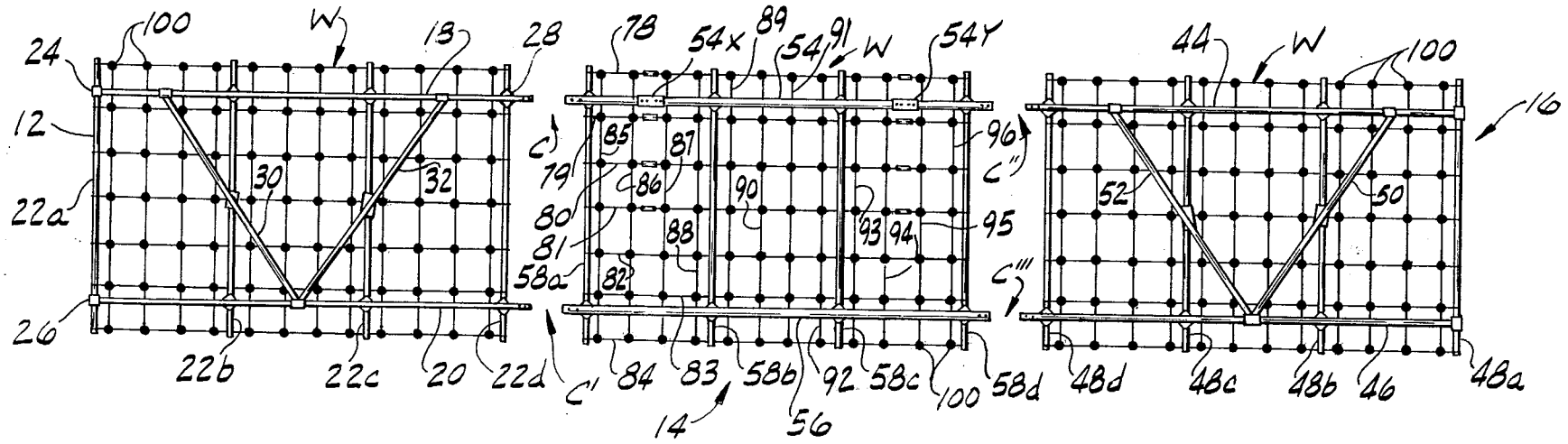
FIG. 4 is a top view of the sign structure per se with the sections thereof disconnected and showing the wire grids.

With particular reference to FIG. 4 there is shown a wire grid assembly referred to by the letter W carried on each of end sections 12, 16 and intermediate section 14. As specifically shown in respect to intermediate section 14, each of the wire grids W include a plurality of elongated parallel, spaced wires 78 through 84 extending parallel with support members 54, 56; and a plurality of elongated, parallel, spaced wires 85 through 96 extending parallel with stabilizer members 58*a*, 58*b*, 58*c*, 58*d*. Also each wire is secured to an intersecting wire, as by tying with thinner gauge wire, to prevent the wires from shifting with respect to each other. Further at each intersection between a wire and a stabilizer member the wire is passed through a transverse hole in the member and tied thereto to further maintain the integrity of the grid.

As can be best seen in FIG. 4 the wire intersections (each represented by a small black dot) cooperate to form a rectangular matrix and adjacent each intersection there is provided an electrically controlled light source assembly 100 (see FIG. 10) as will be further described hereinafter.

As depicted in FIGS. 3 and 4, end section 12 is releasably connected to intermediate section 14 only at connecting points C and C′, and end section 16 is releasably connected to intermediate section 14 only at connecting points C″ and C‴. Each of the connecting points C, C′, C″, C‴ operate identically and an enlarged view of connecting point C is depicted in FIGS. 5 and 6.

With reference to FIGS. 5 and 6, it is shown that end 18*b* of support member 18 is of a diameter less than that of support member 54 and therefore end 18*b* may be telescopically inserted into member 54 until end 54*e* of member 54 abuts against flattened edge 28*a* of plate 28. At that time, transverse holes 18*h* and 18*i* in member 18 align with transverse holes 54*h* and 54*i* respectively. Subsequent to such alignment, securing means (not shown) such as a nut and bolt may be inserted through the aligned holes thus releasably connecting support member 18 to support member 54 so that the members are located coaxially.

It will be appreciated that by using a similar connecting structure at each of points C, C′, C″, C‴, support members 18, 54, 44 will be located coaxially, and support members 20, 56 and 46 will be located coaxially, after assembly of sections 12, 14 and 16.

Figure 7:
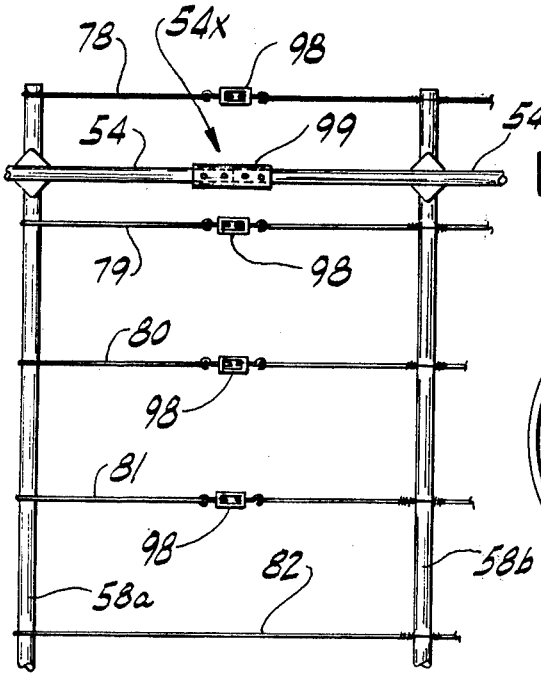
FIG. 7 is an enlarged top view of the intermediate section of the structure showing the area which may be releasably disengaged to allow fitting the structure around the landing gear of the helicopter.

It was discussed previously herein that in order to mount intermediate section 14 beneath helicopter H, support member 54 was reconnectably severed at points 54*x* and 54*y*. Further, wires 78, 79, 80 and 81 are also reconnectably severed by means of turnbuckles 98 connected between the wire severed ends. FIG. 7 shows an enlarged detail view of the area around point 54*x* which is identical in construction to the area around point 54*y*. A tubular sleeve 99 of inside diameter slightly greater than the outside diameter of support member 54 is placed over the severed ends of member 54 and a pair of bolts are inserted into holes in each severed end of member 54 and through aligned holes in sleeve 99 ot reconnect member 54 after intermediate section 14 is moved into place beneath helicopter H. Further, each of turnbuckles 98 may be disconnected and reconnected after a respective wire is moved past landing gear L during connection of sign structure 10 to helicopter H.

Figure 8:
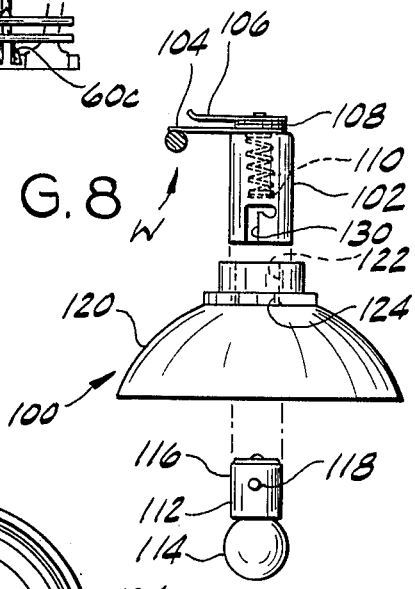
FIG. 8 is an exploded side view of a typical electrically energized light bulb assembly according to the present invention.
Figure 9:
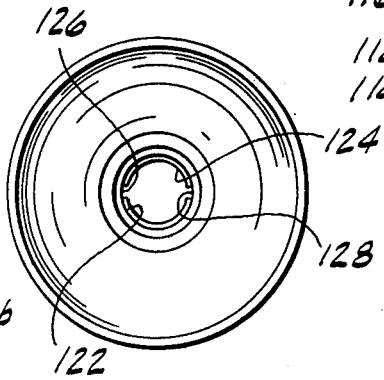
FIG. 9 is a bottom view of the reflector per se of the light bulb assembly of FIG. 8.
Figure 10:
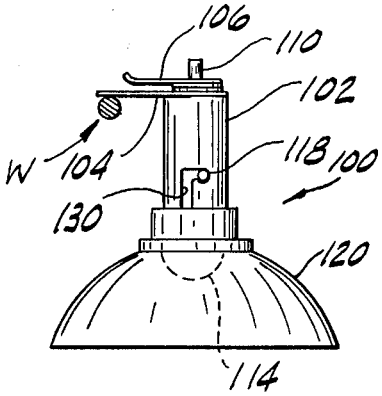
FIG. 10 is a side view of the light bulb assembly in the operational configuration thereof.

Turning to FIGS. 8–10 there is shown an electrically controlled light source assembly 100 according to the present invention which is attached as by soldering adjacent each intersection of wires of the wire grids W. Assembly 100 includes a generally cylindrical base member 102. Base member 102 carries a ground terminal 104 and a power terminal 106 separated by an insulating disc 108. Power terminal 106 is in electrical communication with spring loaded power contact 110. Ground terminal 104 is in electrical communication with base member 102. A commercially available light bulb 112 has a light emitting filament end 114 and a generally cylindrical contact end 116 carrying diametrically opposed detents 118. A dished reflector 120 has a central orifice 122 and a radially inwardly directed flange 124 within orifice 122. Diametrically opposed slots 126, 128 are formed in flange 124 for permitting the insertion of detents 118 therethrough. The inside diameter of flange 124 is such that contact end 116 of bulb 112 may be frictionally force fitted within flange 124 thereby creating a permanent sub-assembly between bulb 112 and reflector 120. Thereafter, contact end 116 of bulb 112 may be inserted into base member 102 and detents 118 locked into J-slots 130 against the pressure of spring loaded contact 110.

Therefore, it can be seen that light source assembly 100 provides a means for quick connect and disconnect of bulb 112 and reflector 120 onto base member 102 while base member 102 is permanently attached to wire grid W. Bulb 112 and reflector 120 will not become loosened from base member 102 during flight; however, when a bulb needs replacement it is a simple matter of removing the bulb and reflector subassembly and replacing it with a new one.

Grids W are formed of electrically conductive wire and are grounded to the helicopter frame through the tubular metal frame of sign structure 10. Therefore, each ground terminal 104 of light source assemblies 100 is gounded. Each light source 100 may then be selectively illuminated by an energizing electrical signal through the individual power line (not shown) connected to the power terminal thereof. Thus the sign structure may be used in conjunction with a computer terminal to display a travelling-type message.

Sign structure 10 is preferably about 35 feet long and 8 feet wide and as shown may be flown in a horizontal position with the longitudinal axis of the sign being perpendicular to the longitudinal axis of the helicopter frame. The sign structure is aerodynamically stable and does not interfere with the safe operation of the aircraft which is of course of paramount importance. The fact that all of the lights are reflected downwardly also provides a safety feature in that the helicopter pilot will not be blinded or distracted by the lights of the sign.

It can therefore be seen that sign structure 10 accomplishes all of the objects of the invention as specifically set forth above and as are inherent in the description of the preferred embodiment thereof.

Since numerous changes may be made to the invention as described with respect to the preferred embodiment without departing from the spirit and scope thereof, it is therefor requested that the scope of the invention be determined solely by the language of the following claims.

We claim:

1. A sign structure comprising:

a first end section including first and second parallel, spaced, elongated support members, and a plurality of parallel, spaced, elongated stabilizer members perpendicular to said first and second support members and fixedly connected thereto;

an intermediate section including third and fourth parallel, spaced, elongated support members, and a plurality of parallel, spaced elongated stabilizer members perpendicular to said third and fourth support members and fixedly connected thereto;

a second end section including fifth and sixth parallel, spaced, elongated support members, and a plurality of parallel, spaced, elongated stabilizer members perpendicular to said fifth and sixth support members and fixedly connected thereto;

a separate grid assembly attached to each of said first end, intermediate and second end sections, each of said grid assemblies including a plurality of parallel, spaced, elongated grid members extending parallel with said stabilizer members and a plurality of parallel, spaced elongated grid members extending parallel with said support members, thereby defining a matrix of elongated grid member intersections;

means for releasably connecting said first support member to said third support member; means for releasably connecting said second support member to said fourth support member; means for releasably connecting said third support member to said fifth support member; and means for releasably connecting said fourth support member to said sixth support member;

whereby, after connection of said support members, said first, third, and fifth support members are located coaxially, and said second, fourth and sixth support members are located coaxially.

2. A sign structure as specified in claim 1 and further characterized by:

an electrically controlled light source attached to each of said grid assemblies adjacent each of said intersections of said elongated grid members.

3. A sign structure as specified in claim 2 and further characterized by:

said electrically controlled light sources each being comprised of a light source assembly; each of said assemblies including; a base member carrying a ground terminal and a power terminal; each ground terminal being attached to and in electrical communication with a respective one of said elongated grid members; each of said power terminals being connected to a separate power line; a reflector member having a central bulb passageway; a light bulb frictionally force-fitted within said passageway and extending outwardly therefrom; and means on said light bulb for releasable mechanical engagement within said base member; whereby said bulb and said reflector member form a subassembly for connection to said base member.

4. A sign structure as specified in claim 1 and further characterized by:

separate reinforcing means on each of said end sections;

each of said reinforcing means including first and second reinforcing members attached to and extending between respective ones of said support members;

said first reinforcing member extending across one of said stabilizer members, and said second reinforcing member extending across another of said stabilizer members on a respective one of said end sections.

5. A sign structure as specified in claim 1 and further characterized by:

said support members and said stabilizer members being fabricated of tubular metal stock material.

6. A sign structure as specified in claim 5 and further characterized by:

the ends of said third support member being telescopically engageable with respective ends of said first and fifth support members;

the ends of said fourth support member being telescopically engageable with respective ends of said second and sixth support members; and securing means transversly and releasably passing through the telescopically engaged ends of said support members to releasably connect said engaged ends of said support members.

7. A sign structure as specified in claim 6 and further characterized by:

said third support member being of a different diameter tubular stock material than said first and fifth support members;

said fourth support member being of a different diameter tubular stock material than said second and sixth support members.

8. A helicopter display sign for use with a helicopter having a substantially horizontal, elongated frame and a downwardly projecting landing gear, said sign comprising:

an elongated grid structure carrying a plurality of electrically energized light sources;

said light sources being directed downwardly and being positioned in a rectangular matrix;

support means adapted to be connected to such helicopter for supporting said grid from such helicopter so that the longitudinal axis of said grid is positioned below and transverse to the longitudinal axis of such helicopter frame; and the ends of said grid structure projecting outwardly of the respective sides of such helicopter frame and projecting beyond said repective sides of such landing gear.

9. A helicopter display sign as specified in claim 8 and further characterized by:

said grid structure includes first and second end sections, and an intermediate section releasably connected between said end sections.

10. A helicopter display sign as specified in claim 9 and further characterized by:

said first end section including first and second parallel, spaced, elongated support members, and a plurality of parallel, spaced, elongated stabilizer members perpendicular to said first and second support members and fixedly connected thereto;

an intermediate section including third and fourth parallel, spaced, elongated support members, and a plurality of parallel spaced, elongated stabilizer members perpendicular to said third and fourth support members and fixedly connected thereto;

a second end section including fifth and sixth parallel, spaced, elongated support members, and a plurality of parallel, spaced, elongated stabilizer members perpendicular to said fifth and sixth support members and fixedly connected thereto;

a separate grid assembly attached to each of said first end, intermediate and second end sections, each of said grid assemblies including a plurality of parallel, spaced, elongated grid members extending parallel with said stabilizer members and a plurality of parallel, spaced elongated grid members extending parallel with said support members, thereby defining a matrix of grid member intersections;

said light sources being attached to each of said grid assemblies adjacent each of said intersections of said grid members;

means for releasably connecting said first support member to said third support member; means for releasably connecting said second support member to said fourth support member; means for releasably connecting said third support member to said fifth support member; and means for releasably connecting said fourth support member to said sixth support member;

whereby, after connection of said support members, said first, third and fifth support members are located coaxially, and said second, fourth and sixth support members are located coaxially.

11. A helicopter display sign as specified in claim 10 and further characterized by:

said intermediate section having first, second, third and fourth stabilizer members; said third support member being reconnectably severed between said first and second stabilizer members, and being reconnectably severed between said third and fourth stabilizer members;

a plurality of said grid members on said intermediate section being reconnectably severed at locations along lines which are parallel to said stabilizer members and which intersect the severed locations in said third support member;

whereby said third support member and said plurality of said grid members may be temporarily split to permit movement of said intermediate section around the helicopter landing gear during connection and disconnection of said grid assembly to such helicopter.

12. An aerial sign structure for use with an aircraft having a downwardly projecting landing gear, said sign structure comprising:

an elongated grid structure adapted to be supported beneath such aircraft;

said grid structure carrying a plurality of electrically energized light sources;

said light sources being directed downwardly and being positioned in a rectangular matrix;

said grid structure being comprised of first and second end sections, and an intermediate section releasably connected to and between said end sections.

13. An aerial sign as specified in claim 12 and further characterized by:

said first end section including first and second parallel, spaced, elongated support members, and a plurality of parallel, spaced, elongated stabilizer members perpendicular to said first and second support members and fixedly connected thereto;

said intermediate section including third and fourth parallel, spaced, elongated support members, and a plurality of parallel, spaced, elongated stabilizer members perpendicular to said third and fourth support members and fixedly connected thereto;

said second end section including fifth and sixth parallel, spaced, elongated support members, and a plurality of parallel, spaced, elongated stabilizer members perpendicular to said fifth and sixth support members and fixedly connected thereto;

a separate grid assembly attached to each of said first end, intermediate and second end sections, each of said grid assemblies including a plurality of parallel, spaced, elongated grid members extending parallel with said stabilizer members and a plurality of parallel, spaced elongated grid members extending parallel with said support members, thereby defining a matrix of grid member intersections;

said light sources being attached adjacent to each of said grid member intersections;

means for releasably connecting said first support member to said third support member; means for releasably connecting said second support member to said fourth support member; means for releasably connecting said third support member to said fifth support member; and means for releasably connecting said fourth support member to said sixth support member;

whereby, after connection of said support members, said first, third, and fifth support members are located coaxially and said second, fourth and sixth support members are located coaxially.

14. An aerial sign as specified in claim 13 and further characterized by:

said intermediate section having first, second, third and fourth stabilizer members; said third support member being reconnectably severed between said first and second stabilizer members, and being reconnectably severed between said third and fourth stabilizer members;

a plurality of said grid members on said intermediate section being reconnectably severed at locations along lines which are parallel to said stabilizer members and which intersect the severed locations in said third support member;

whereby said third support member and said plurality of said grid members may be temporarily split to permit movement of said intermediate section around said landing gear during connection and disconnection of said grid to such aircraft.

* * * * *